US006694952B1

(12) United States Patent
Yamazaki et al.

(10) Patent No.: US 6,694,952 B1
(45) Date of Patent: Feb. 24, 2004

(54) HIGH-PRESSURE FUEL PUMP AND CAM FOR HIGH-PRESSURE FUEL PUMP

(75) Inventors: Daichi Yamazaki, Toyota (JP); Masanori Sugiyama, Aichi-gun (JP); Naoki Kurata, Nishikamo-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 1 day.

(21) Appl. No.: 09/612,526

(22) Filed: Jul. 6, 2000

(30) Foreign Application Priority Data

Jul. 28, 1999 (JP) ..... 11-214217

(51) Int. Cl.[7] ..... F02M 37/04
(52) U.S. Cl. ..... 123/496; 123/506
(58) Field of Search ..... 123/496, 506, 123/456, 446, 447

(56) References Cited

U.S. PATENT DOCUMENTS

| | | | | |
|---|---|---|---|---|
| 4,308,839 A | * | 1/1982 | Hafner et al. | 123/496 |
| 4,643,155 A | * | 2/1987 | O'Neill | 123/506 |
| 5,094,216 A | * | 3/1992 | Miyaki et al. | 123/506 |
| 5,511,956 A | * | 4/1996 | Hasegawa et al. | 417/271 |
| 5,823,168 A | * | 10/1998 | Otoh et al. | 123/496 |
| 6,311,674 B1 | * | 11/2001 | Igashira et al. | 123/458 |

FOREIGN PATENT DOCUMENTS

| | | |
|---|---|---|
| EP | 0 481 964 A | 4/1992 |
| EP | 0 501 463 A | 9/1992 |
| GB | 317 320 | 3/1930 |
| JP | 4-237867 | 8/1992 |
| JP | 7-4332 | 1/1995 |
| JP | A-10-176618 | 6/1998 |
| JP | A-10-176619 | 6/1998 |
| JP | 11-193764 | 1/1999 |

OTHER PUBLICATIONS

English–language abstract of JP–A–04–237867.
English–language abstract of JP A–07–004332.

* cited by examiner

*Primary Examiner*—Carl S. Miller
(74) *Attorney, Agent, or Firm*—Oliff & Berridge, PLC

(57) ABSTRACT

A cam for driving a high-pressure fuel pump has a cam profile that is asymmetric for the suction stroke and the ejection stroke. The cam profile is set so that the cam angle for the ejection stroke is greater than the cam angle for the suction stroke. Therefore, even when the cam drive shaft is rotating at a constant speed, the duration of the ejection stroke becomes longer than the duration of the suction stroke. That is, the changing speed of the capacity of a pressurizing chamber becomes less during the ejection stroke than during the suction stroke.

10 Claims, 4 Drawing Sheets

HIGH-PRESSURE FUEL PUMP AND CAM FOR HIGH-PRESSURE FUEL PUMP

INCORPORATION BY REFERENCE

The disclosure of Japanese Patent Application No. 11-214217 filed on Jul. 28, 1999 including the specification, drawings and abstract is incorporated herein by reference in its entirety.

BACKGROUND OF THE INVENTION

1. Field of the Invention

The invention relates to a high-pressure fuel pump that pumps fuel from a fuel tank to a high-pressure fuel injection system of an internal combustion engine and regulates the amount of fuel pumped (amount of fuel ejected) by using a spill valve, and also relates to a cam for the high-pressure fuel pump.

2. Description of Related Art

Related high-pressure fuel pumps are described in, for example, Japanese Patent Application Laid-Open Nos. 10-176618 and 10-176619, and the like.

In a typical high-pressure fuel pump of this type, a plunger disposed in a cylinder is reciprocated by a cam that is rotated by an internal combustion engine, as described in the aforementioned laid-open patent applications. During the suction stroke during which a pressurizing chamber defined by the cylinder and the plunger is expanded in capacity, fuel is drawn from a fuel tank into the pressurizing chamber. An amount of fuel drawn into the pressurizing chamber is ejected into a fuel injection passage during the ejection stroke during which the pressurizing chamber is reduced in capacity. During the ejection stroke, the closed valve duration of a spill valve (electromagnetic spill valve) is controlled. A substantive amount of fuel ejected during the ejection stroke is determined in accordance with the closed valve duration of the spill valve controlled during the ejection stroke. That is, while the spill valve is open, fuel pressurized in the pressurizing chamber is allowed to spill into a low-pressure passage even during the ejection stroke. It is not until the spill valve is closed at an appropriate timing during the pressurization of fuel that the fuel ejection into the ejection passage starts. Then, at a timing at which the spill valve is opened again, fuel starts to spill into the low-pressure passage so that the fuel ejection discontinues. By using the spill valve in this manner, the high-pressure fuel pump allows high-precision adjustment of the fuel ejection amount.

During operation of the high-pressure fuel pump, the pressure that is applied to fuel present in the pressurizing chamber as the plunger moves in the chamber-capacity reducing direction during the ejection stroke acts on the spill valve in the valve closing direction. Therefore, when the spill valve is closed at a certain timing during the fuel ejection stroke, the fuel pressure accelerates the closing speed of the spill valve, so that the impact noise produced upon the closure of the valve increases. Particularly during a low-load operation state of the engine, such as an idling operation state or the like, the operational noise produced by the engine is less than during other operational states of the engine, so that the operational noise (impact noise) produced by the high-pressure fuel pump relatively increases to a level that cannot be ignored.

SUMMARY OF THE INVENTION

Accordingly, it is an object of the invention to provide a high-pressure fuel pump capable of suitably reducing the operational noise related to the closure of a spill valve even during a low-load operation state of an internal combustion engine, such as an idling operation state and the like.

A first aspect of the invention provides a high-pressure fuel pump having a plunger disposed in a cylinder and which is reciprocated by a cam rotated by an internal combustion. Fuel is drawn from a fuel tank into a pressurizing chamber defined by the cylinder and the plunger during a suction stroke during which a capacity of the pressurizing chamber is increased. An amount of fuel that is regulated based on a control of a closed valve period of a spill valve is ejected from the pressurizing chamber into an ejection passage during an ejection stroke during which the capacity of the pressurizing chamber is reduced. The high pressure fuel pump includes a speed variation device for achieving a smaller changing speed of the capacity of the pressurizing chamber during the ejection stroke than during the suction stroke.

The pressure occurring in fuel in the pressurizing chamber during a movement of the plunger in the capacity reducing direction acts on the spill valve in the valve closing direction, as mentioned above. The magnitude of the pressure acting on the spill valve in the valve closing direction depends on the moving speed of the plunger in the capacity reducing direction, that is, the changing (reducing) speed or rate of the capacity of the pressurizing chamber during the ejection stroke. Therefore, if the changing speed of the capacity of the pressurizing chamber during the ejection stroke is made less than the changing speed of the capacity of the pressurizing chamber during the suction stroke, the pressure acting on the spill valve in the valve closing direction can be reduced and, therefore, the impact noise produced at the time of closure of the spill valve can also be reduced. Such a reduction in the impact noise at the time of closure of the spill valve results in a good reduction in the operational noise of the high-pressure fuel pump during the low-load operation state of the internal combustion engine, such as the idling operation state and the like.

In the high-pressure fuel pump described above, the speed variation means may include the cam. The cam may be constructed so that the cam has an asymmetric cam profile for the ejection stroke and the suction stroke and so that a cam angle for the ejection stroke is greater than a cam angle for the suction stroke.

Due to the cam profile setting that makes the turning angle of the cam during the ejection stroke greater than the turning angle of the cam during the suction stroke, the cam provides a smaller changing speed of the capacity of the pressurizing chamber during the ejection stroke than a cam having a symmetric cam profile for the suction stroke and the ejection stroke. Therefore, the aforementioned operational noise reducing advantage can be achieved easily and reliably.

The cam profile of the cam may also be set so that the changing speed of the capacity of the pressurizing chamber with respect to the cam angle becomes substantially constant during at least a part of the ejection stroke.

The provision of a cam profile portion for a constant changing speed of the capacity of the pressurizing chamber during the ejection stroke brings about a linear change in the amount of fuel ejected. Therefore, in a case where the amount of fuel ejected from the pressurizing chamber is regulated based on a control of the closed valve period of the spill valve, as for example, it becomes possible to perform the closed valve period control in a simplified manner based on a simplified calculation process.

A second aspect of the invention provides a cam for driving a high-pressure fuel pump Having a plunger disposed in a cylinder and that is reciprocated by the cam, which is rotated by an internal combustion engine. Fuel is drawn from a fuel tank into a pressurizing chamber defined by the cylinder and the plunger during a suction stroke during which capacity of the pressurizing chamber is increased. An amount of fuel that is regulated based on a control of a closed valve period of a spill valve is ejected from the pressurizing chamber into an ejection passage during an ejection stroke during which the capacity of the pressurizing chamber is reduced. The cam has a cam profile which is asymmetric for the ejection stroke and the suction stroke, and in which a cam angle for the ejection stroke is greater than a cam angle for the suction stroke.

The adoption of the above-described cam reduces the plunger speed (the changing (reducing) speed of the capacity of the pressurizing chamber) during the ejection stroke, and therefore reduces the operation noise of the high-pressure fuel pump resulting from the impact noise occurring at the time of closure of the spill valve.

In the above-described cam, the cam profile may be set so that the changing speed of the capacity of the pressurizing chamber with respect to the cam angle becomes substantially constant during at least a part of the ejection stroke.

This cam profile allows a simplified control of the closed valve period of the spill valve based on a simplified calculation process.

A third aspect of the invention includes a method of pumping fuel at a high pressure using the structure described above.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS

Preferred embodiments of the high-pressure fuel pump of the invention will be described in detail hereinafter with reference to the accompanying drawings.

Figure 1:
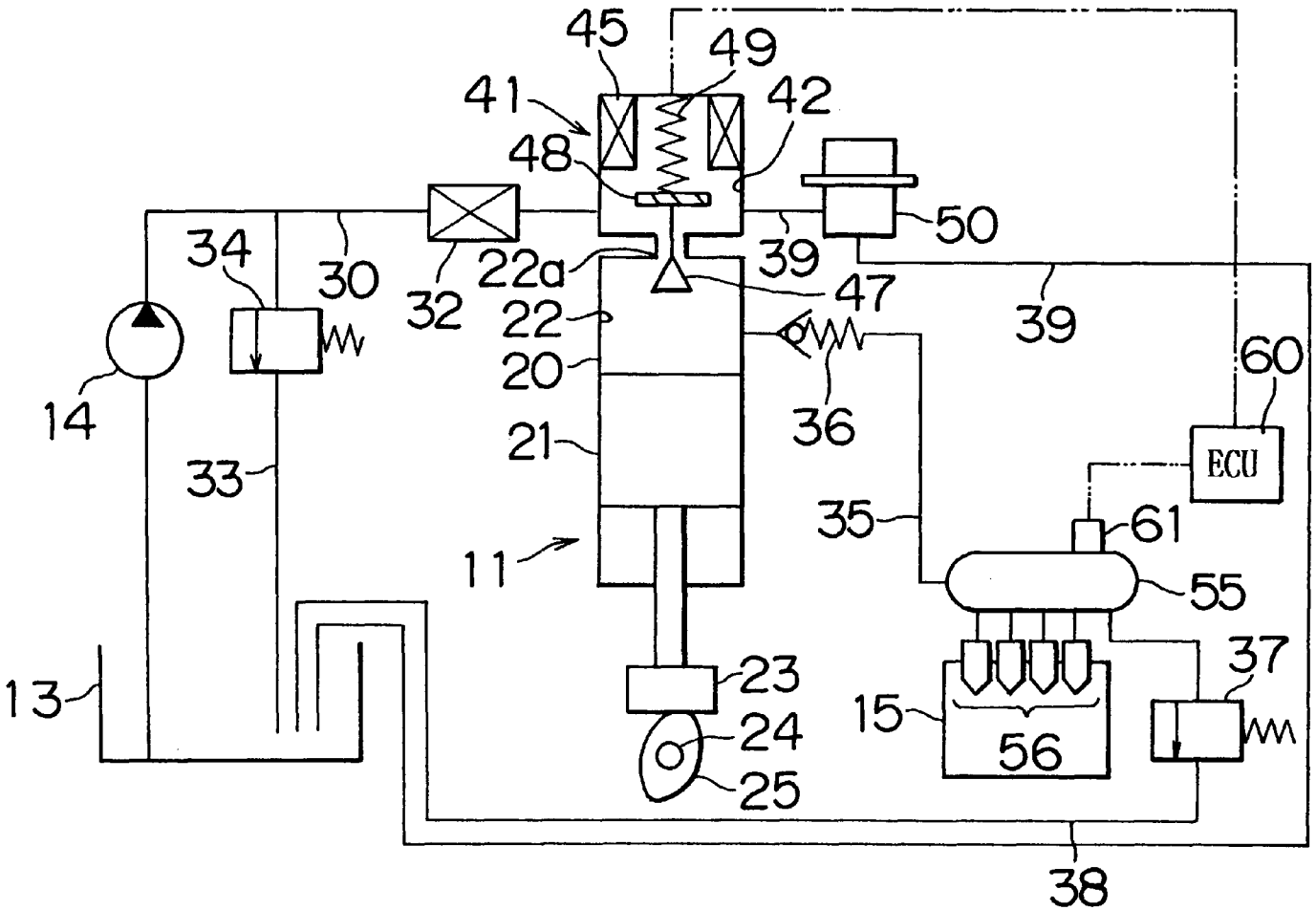
FIG. 1 is a schematic block diagram of a construction of one preferred embodiment of the high-pressure fuel pump of the invention.

FIG. 1 is a schematic illustration of a high-pressure fuel injection apparatus incorporating a high-pressure fuel pump according to an embodiment of the invention. The high-pressure fuel injection apparatus is an apparatus for injecting high-pressure fuel directly into each cylinder of an engine (internal combustion engine) 15. The apparatus has a high-pressure fuel pump 11, a fuel tank 13, a low-pressure feed pump 14, a pressure accumulating piping (e.g., a delivery pipe, a common rail, etc.) 55, injectors 56, and the like.

The high-pressure fuel pump 11 pressurizes fuel to a high pressure, and pumps pressurized fuel to the pressure accumulating piping 55. The high-pressure fuel pump 11 has a cylinder 20, a plunger 21 reciprocally movable in the cylinder 20, a pressurizing chamber 22 defined by an inner peripheral surface of the cylinder 20 and an upper end surface of the plunger 21, a low-pressure chamber 42, and a spill valve (electromagnetic spill valve) 41 provided between the pressurizing chamber 22 and the low-pressure chamber 42.

In the high-pressure fuel pump 11 constructed as described above, a tappet 23 connected to a lower end (lower end in FIG. 1) of the plunger 21 is pressed against a cam 25 by force from a spring (not shown). The cam 25 is provided on a drive shaft 24 that is connected to a crankshaft or a camshaft of the engine 15. As the cam 25 rotates with rotation of the drive shaft 24, the plunger 21 is reciprocated in the cylinder 20, changing the capacity of the pressurizing chamber 22. In this embodiment, the cam 25 has asymmetric cam profiles for the suction stroke and the ejection stroke. The asymmetric cam 25 will be described in detail below with reference to FIG. 2.

The pressurizing chamber 22 is connected to the fuel tank 13 via the spill valve 41 and a suction passage 30. The suction passage 30 is provided with the low-pressure feed pump 14 and a fuel filter 32. The low-pressure feed pump 14 is electrically driven under control of an electronic control unit (hereinafter, referred to as "ECU") 60 that controls the operation of the engine 15. The low-pressure feed pump 14 draws fuel from the fuel tank 13, and delivers fuel to the high-pressure fuel pump 11. In the course of fuel delivery, contaminants are removed from fuel by the fuel filter 32.

After being delivered to the high-pressure fuel pump 11 via the suction passage 30, fuel is introduced into the pressurizing chamber 22 via the spill valve 41. The spill valve 41 is an electromagnetic valve that is controlled to a closed state or an open state based on electrification of a solenoid 45 under control of the ECU 60. More specifically, the spill valve 41 is a normally-open type electromagnetic valve that is kept in the open state when the solenoid 45 is not electrified and, therefore, a stator (not shown) is not magnetized. In the open valve state, a valve body 47 of the spill valve 41 is held apart from an aperture portion 22*a* of the pressurizing chamber 22 by force from a spring 49. When the stator is magnetized by the solenoid 45, an armature 48 is moved toward the stator, overcoming the force from the spring 49, so that the valve body 47 closes the aperture portion 22*a*, thus entering the closed valve state.

A portion of the suction passage 30 that extends between the low-pressure feed pump 14 and the fuel filter 32 is connected to the fuel tank 13 via a relief passage 33. A relief valve 34 is provided in the relief passage 33. The relief valve 34 opens when the fuel pressure in the portion of the suction passage 30 extending between the low-pressure feed pump 14 and the fuel filter 32 becomes equal to or greater than a predetermined value. When the relief valve 34 opens, fuel returns from the suction passage 30 to the fuel tank 13 via the relief passage 33. As a result, the pressure of fuel delivered from the low-pressure feed pump 14 to the fuel filter 32 is kept substantially constant.

A spill passage 39 extending between the spill valve 41 (low-pressure chamber 42) and the fuel tank 13 is provided with a pressure regulator 50. When the spill valve 41 is open, fuel whose pressure is higher than the valve-opening pressure of the pressure regulator 50 returns to the fuel tank 13 via the spill passage 39.

The pressure accumulating piping 55 is connected to the pressurizing chamber 22 via an ejection passage 35 and a check valve 36. The pressure accumulating piping 55 maintains a high pressure of fuel, and distributes high-pressure fuel into the injectors 56 provided for the individual cylinders of the engine 15. Each injector 56 is opened and closed on the basis of a drive signal from the ECU 60 so as to inject a predetermined amount of fuel directly into the corresponding one of the cylinders of the engine 15. The check valve 36 provided in the ejection passage 35 allows fuel to flow only in the direction from the pressurizing chamber 22 to the pressure accumulating piping 55, and prevents reverse flow of fuel from the pressure accumulating piping 55 to the pressurizing chamber 22.

The pressure accumulating piping 55 is connected to the fuel tank 13 via a relief passage 38 that has a relief valve 37. When the fuel pressure in the pressure accumulating piping 55 increases to or above a predetermined value, the relief valve 37 opens, so that fuel returns from the pressure accumulating piping 55 to the fuel tank 13 via the relief passage 38. Therefore, the fuel pressure in the pressure accumulating piping 55 is prevented from excessively rising. The pressure accumulating piping 55 is provided with a fuel pressure sensor 61. The fuel pressure in the pressure accumulating piping 55 is detected by the fuel pressure sensor 61, and is monitored by the ECU 60. The ECU 60 includes a microcomputer (not shown) having a CPU, a RAM, I/O ports, and the like.

In the high-pressure fuel pump 11 in this embodiment, the cam 25 for reciprocating the plunger 21 is a cam whose cam profile is asymmetric for the suction stroke and the ejection stroke, as mentioned above. The cam profile of the cam 25 is shown in an enlarged view in FIG. 2.

Figure 2:
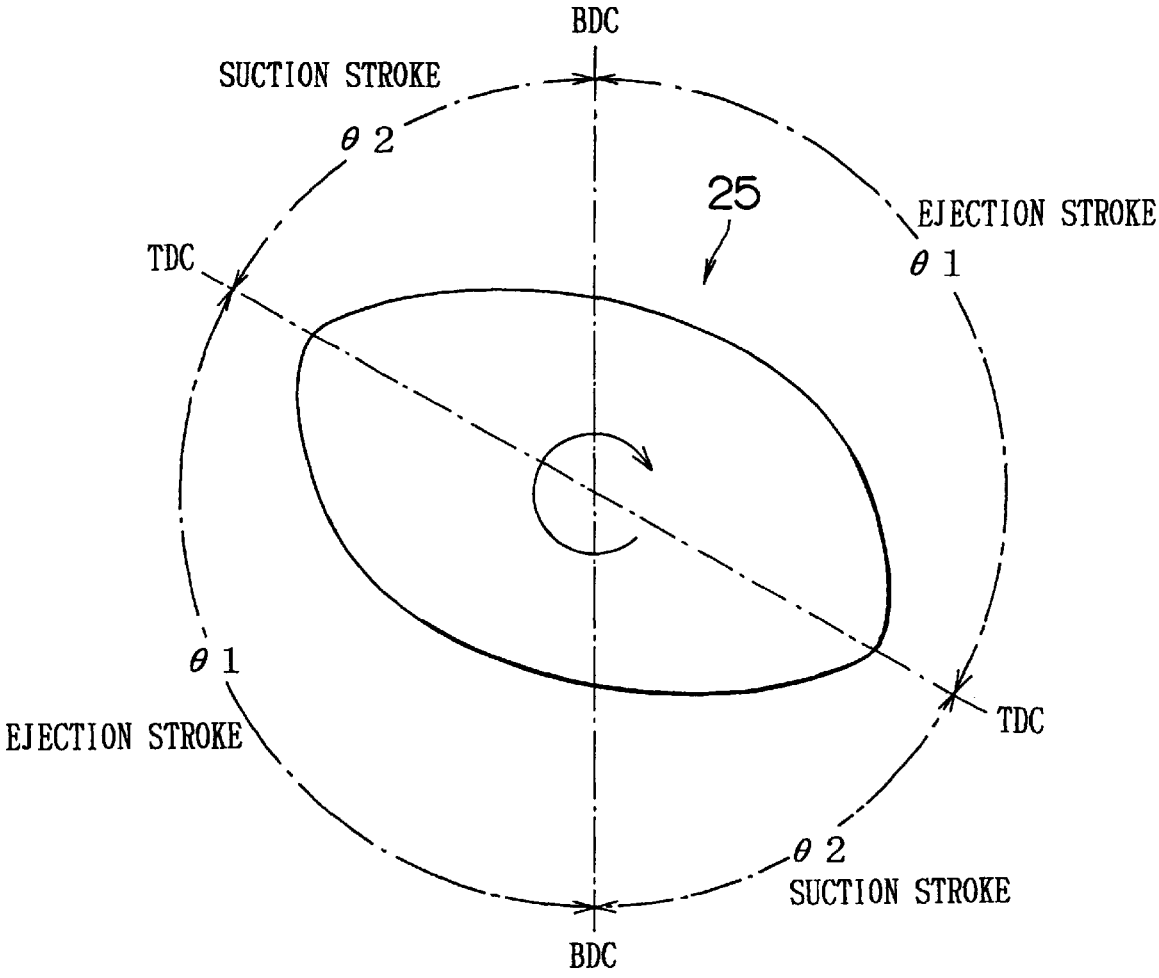
FIG. 2 is a schematic illustration of a configuration of a pump-driving cam adopted in the FIG. 1 embodiment.

As shown in FIG. 2, the cam 25 has two portions for each of the suction stroke and the ejection stroke. Of these portions of the cam 25, the portions corresponding to the ejection stroke θ1 are larger than the portions corresponding to the suction stroke θ2. More specifically, the cam angle corresponding to the ejection stroke θ1 is greater than the cam angle corresponding to the suction stroke θ2. Therefore, the changing (expanding) speed or rate of the capacity of the pressurizing chamber 22 during the suction stroke is greater than the changing (reducing) speed or rate of the capacity of the pressurizing chamber 22 during the ejection stroke, even when the rotating speed of the drive shaft 24 of the cam 25 is constant.

The operation of the high-pressure fuel pump of this embodiment, constructed as described above, will be described with reference to FIGS. 3A and 3B.

Figure 3A:
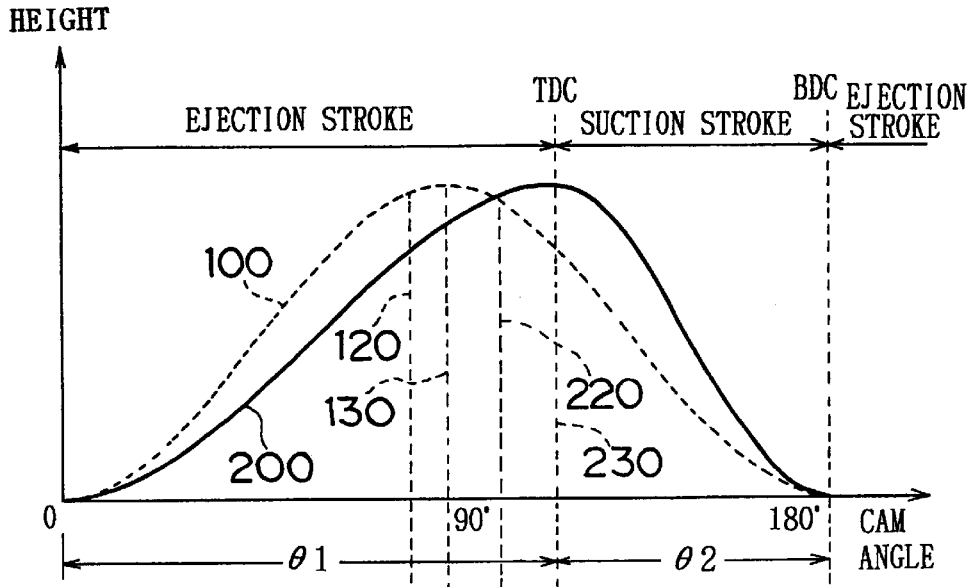
FIG. 3A is a graph indicating changes in the lift with respect to the cam angle of the cam shown in FIG. 2.

In FIG. 3A, solid line 200 and broken line 100 show the height of the plunger 21 in relation to the cam 25 angle. The broken line 100 has broken line 120 showing where the spill valve 41 is closed and broken line 130 showing where spill valve 41 is opened in the related art high pressure valve. The solid line 200 has broken line 220 showing where the spill valve 41 is closed and broken line 230 showing where the spill valve 41 opens in the invention. When the operation of the engine 15 is started, the cam 25 rotates with rotation of the drive shaft 24, thereby reciprocating the plunger 21 in the cylinder 20 in the vertical directions in FIG. 1. Fuel in the suction passage 30, supplied from the fuel tank 13 via the low-pressure feed pump 14, is introduced into the pressurizing chamber 22 via the spill valve 41 set in the open state simultaneously with the start of a downward movement of the plunger 21 from the top dead center (TDC) 230 during the suction stroke of the high-pressure fuel pump 11.

When the plunger 21 starts to move upward from the bottom dead center (BDC) during the ejection stroke of the high-pressure fuel pump 11, a portion of the amount of fuel in the pressurizing chamber 22 flows into the spill passage 39 via the spill valve 41 and returns toward the fuel tank 13 via the pressure regulator 50 during the open valve period of the spill valve 41. That is, even though the high-pressure fuel pump 11 is in the ejection stroke, fuel is not pumped from the pressurizing chamber 22 into the pressure accumulating piping 55 as long as the spill valve 41 remains open.

When the spill valve 41 is closed upon electrification of the solenoid 45, fuel in the pressurizing chamber 22 is pressurized, and pressurized fuel is pumped out to the pressure accumulating piping 55 via the ejection passage 35 and the check valve 36.

During this operation, the ECU 60 controls the amount of fuel pumped into the pressure accumulating piping 55 so that the fuel pressure in the pressure accumulating piping 55 detected by the fuel pressure sensor 61 becomes equal to a predetermined pressure, by adjusting the closed valve period of the spill valve 41, that is, adjusting the timing of starting the electrification of the solenoid 45 and the timing of stopping the electrification.

Normally, when the spill valve 41 closes as shown by broken line 120, great impact noise occurs because fuel pressurized in the pressurizing chamber 22 causes a great force on the spill valve 41 in the closing direction, in addition to the electromagnetic force applied to the spill valve 41 by electrification of the solenoid 45, as mentioned above. The impact noise becomes relatively great particularly during a low-load operation of the engine, such as the idling state or the like, since the operational noise of the engine 15 is small during such an operational state.

In this embodiment, however, the cam 25 has different cam angles for the suction stroke and the ejection stroke of the high-pressure fuel pump 11 as described above, so that the height of the plunger 21 changes with changes in the angular position of the cam 25 in a pattern as indicated by a solid line 200 in FIG. 3A. As can be seen from comparison with the lift change characteristic of a conventional cam having a symmetric cam profile for the suction stroke and the ejection stroke indicated by a broken line 100 in FIG. 3A, the period of the ejection stroke provided by the cam 25 is longer than the period of the ejection stroke provided by the conventional cam. Therefore, the changing rate of the lift per unit cam angle, that is, the moving speed of the plunger (or the changing rate of the capacity of the pressurizing chamber 22), is reduced during the ejection stroke in this embodiment. The plunger speeds caused by the cam 25 of this embodiment and the conventional cam are indicated in FIG. 3B.

Figure 3B:
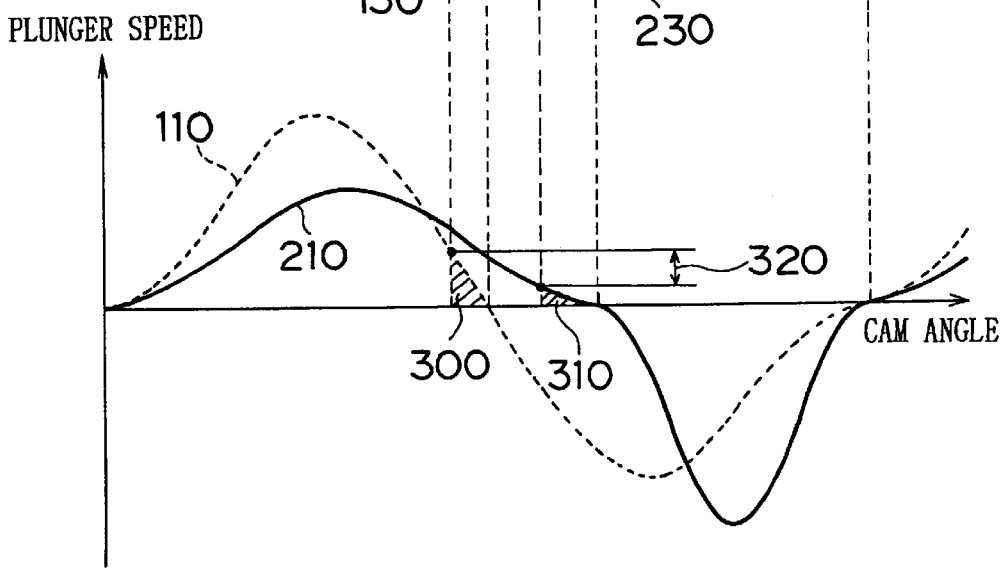
FIG. 3B is a graph indicating changes in the plunger speed with respect to the cam angle.

In FIG. 3B the speed of the plunger versus the cam angle is shown by solid line 210 and broken line 110. The broken line 110 has broken line 120 showing where the spill valve 41 closes and broken line 130 showing where spill valve 41 opens in the related art high pressure valve. The hatched area 300 between broken line 120 and broken line 130 indicates an amount of fuel that is needed for the pressure accumulating piping 55 during the idling state of the engine and that is adjusted in accordance with the closed period of the spill valve 41. The solid line 210 has broken line 220 showing where the spill valve 41 closes and broken line 230 showing where the spill valve 41 opens in the invention. The hatched area 310 between broken line 220 and broken line 230 indicates an amount of fuel that is needed for the pressure accumulating piping 55 during the idling state of the engine and that is adjusted in accordance with the closed period of the spill valve 41. The areas of the hatched regions 300, 310 with respect to the conventional cam (110) and the cams 25 (210) of this embodiment are equal. However, at the timing of closing the spill valve, different plunger speeds are provided by cam 25 of this embodiment with an asymmetric profile and the conventional cam having a symmetric cam profile for the ejection stroke and the suction stroke as shown by hatched regions 300 and 310 in FIG. 3B. That is, as indicated in FIG. 3B, the plunger speed provided by the cam 25 (solid line 210) and the timing of closing the spill valve 41 (broken line 220) is less than the plunger speed provided by the conventional cam (broken line 110) at the spill valve closing timing (broken line 120). The difference in the closing speed of the plunger at the time of closing is shown by gap 320. Therefore, the embodiment reduces the impact noise produced at the time of closure of the spill valve 41.

As can be understood from the above description, the embodiment achieves the following advantages.

Since the cam 25 has a greater cam angle for the ejection stroke than for the suction stroke, the plunger speed provided immediately before closure of the spill valve 41 during the ejection stroke is reduced, so that the impact noise occurring at the time of closure of the spill valve 41 is reduced.

In particular, when the impact noise at the time of closure of the spill valve 41 becomes relatively great due to reduced operational noise of the engine 15, for example, during a low-load engine operation such as the idling operation or the like, the advantage of the impact noise reduction will be highly appreciated, that is, the annoyance to an occupant or the like can be considerably reduced.

The high-pressure fuel pump of this invention is not limited to the foregoing embodiment, but may be embodied in various other forms as described below.

In the foregoing embodiment, the cam 25 has a cam profile that changes the lift in a sine curve fashion or a near-sine curve fashion. However, the above-described cam 25 may be replaced by a cam that achieves a lift change that can be expressed by a linear function during most of the ejection stroke, that is, a cam having a cam profile that achieves a constant changing rate of the capacity of the pressurizing chamber with respect to the cam angle during a part of the ejection stroke or throughout the ejection stroke. Employment of such a cam allows a simplified control of the closed valve period of the spill valve 41 based on a simplified calculation process.

Although in the foregoing embodiment, the cam 25 has two cam lobes, it is also possible to employ a cam having only one cam lobe or more than two cam lobes.

Figure 4:
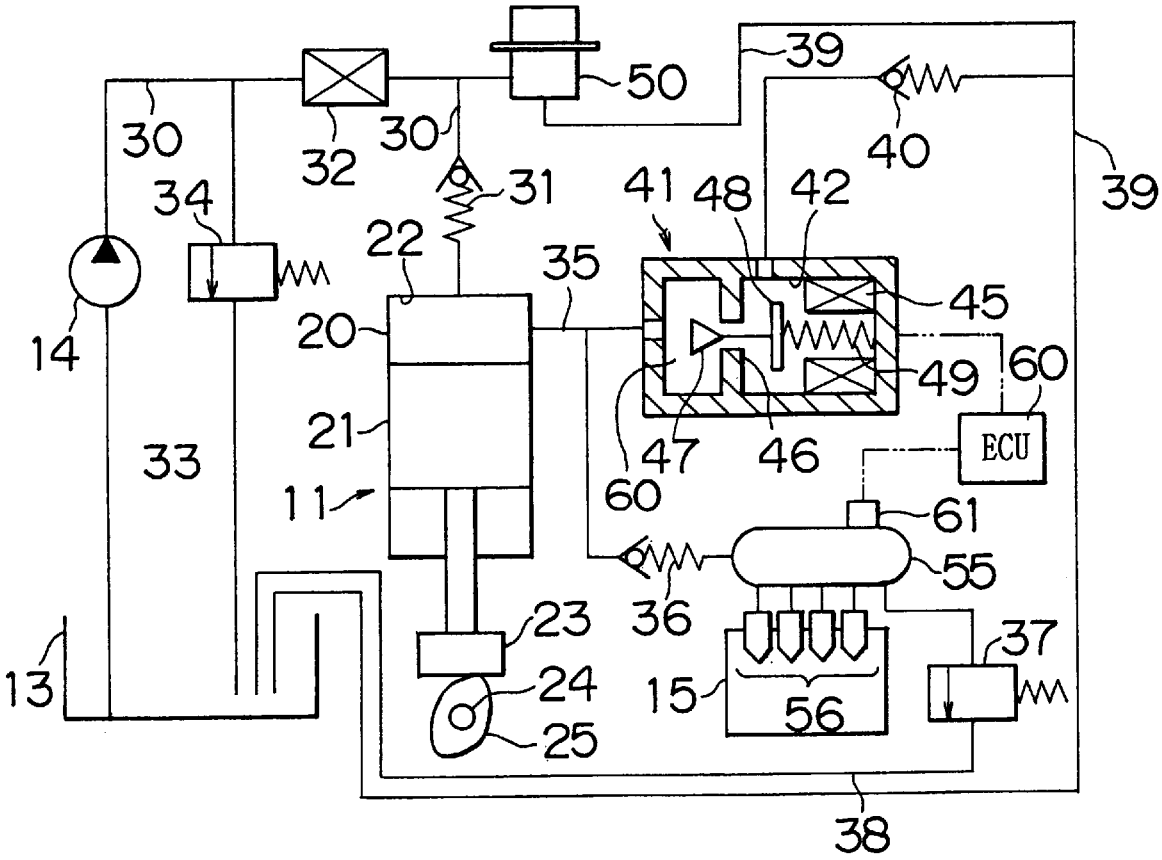
FIG. 4 is a block diagram of a construction of another embodiment of the high-pressure fuel pump of the invention.

In FIG. 4, a second exemplary embodiment of the invention is shown. The apparatus has a high-pressure fuel pump 11, a fuel tank 13, a low-pressure feed pump 14, a pressure accumulating piping (e.g., a delivery pipe, a common rail, etc.) 55, injectors 56, and the like.

The high-pressure fuel pump 11 pressurizes fuel to a high pressure, and pumps pressurized fuel to the pressure accumulating piping 55. The high-pressure fuel pump 11 has a cylinder 20, a plunger 21 reciprocally movable in the cylinder 20, a pressurizing chamber 22 defined by an inner peripheral surface of the cylinder 20 and an upper end surface of the plunger 21, a high pressure chamber 60, a low-pressure chamber 42, and a spill valve (electromagnetic spill valve) 47 provided between the pressurizing chamber 22 and the low-pressure chamber 42. The high pressure chamber 60 is connected to the pressurizing chamber 22 by pressure line 35.

In the high-pressure fuel pump 11 constructed as described above, a tappet 23 connected to a lower end (lower end in FIG. 4) of the plunger 21 is pressed against a cam 25 by force from a spring (not shown). The cam 25 is provided on a drive shaft 24 that is connected to a crankshaft or a camshaft of the engine 15. As the cam 25 rotates with rotation of the drive shaft 24, the plunger 21 is reciprocated in the cylinder 20, changing the capacity of the pressurizing chamber 22. In this embodiment, the cam 25 has asymmetric cam profiles for the suction stroke and the ejection stroke. The asymmetric cam 25 was described in detail above with reference to FIG. 2.

The pressurizing chamber 22 is connected to the fuel tank 13 via the relief valve 31 and a suction passage 30. The suction passage 30 is provided with the low-pressure feed pump 14 and a fuel filter 32. The low-pressure feed pump 14 is electrically driven under control of an electronic control unit (hereinafter, referred to as "ECU") 60 that controls the operation of the engine 15. The low-pressure feed pump 14 draws fuel from the fuel tank 13, and delivers fuel to the high-pressure fuel pump 11. In the course of fuel delivery, contaminants are removed from fuel by the fuel filter 32.

After being delivered to the high-pressure fuel pump 11 via the suction passage 30, fuel is introduced into the pressurizing chamber 22 via the check valve 31. Check valve 31 provided in the suction passage 30 allows fuel to flow only in the direction from the fuel tank 13 to the pressurizing chamber 22, and prevents reverse flow of fuel from the pressurizing chamber 22 to the fuel tank 13.

A portion of the suction passage 30 that extends between the low-pressure feed pump 14 and the fuel filter 32 is connected to the fuel tank 13 via a relief passage 33. A relief valve 34 is provided in the relief passage 33. The relief valve 34 opens when the fuel pressure in the portion of the suction passage 30 extending between the low-pressure feed pump 14 and the fuel filter 32 becomes equal to or greater than a predetermined value. When the relief valve 34 opens, fuel returns from the suction passage 30 to the fuel tank 13 via the relief passage 33. As a result, the pressure of fuel delivered from the low-pressure feed pump 14 to the fuel filter 32 is kept substantially constant.

A spill passage 39 extending between the pressure regulator 50 and the fuel tank 13 is provided. Fuel whose pressure is higher than the valve-opening pressure of the pressure regulator 50 returns to the fuel tank 13 via the spill passage 39.

A second spill passage 39 extending from spill valve 41 to fuel tank 13 via relief valve 40 is provided. When the relief valve 40 opens, fuel returns from the spill valve 41 to the fuel tank 13 via the spill passage 39.

The pressure accumulating piping 55 is connected to the pressurizing chamber 22 via an ejection passage 35 and a check valve 36. The pressure accumulating piping 55 maintains a high pressure of fuel, and distributes high-pressure fuel into the injectors 56 provided for the individual cylinders of the engine 15. Each injector 56 is opened and closed on the basis of a drive signal from the ECU 60 so as to inject a predetermined amount of fuel directly into the corresponding one of the cylinders of the engine 15. The check valve 36 provided in the ejection passage 35 allows fuel to flow only in the direction from the pressurizing chamber 22 to the pressure accumulating piping 55, and prevents reverse flow of fuel from the pressure accumulating piping 55 to the pressurizing chamber 22.

The pressure accumulating piping 55 is connected to the fuel tank 13 via a relief passage 38 that has a relief valve 37.

When the fuel pressure in the pressure accumulating piping 55 increases to or above a predetermined value, the relief valve 37 opens, so that fuel returns from the pressure accumulating piping 55 to the fuel tank 13 via the relief passage 38. Therefore, the fuel pressure in the pressure accumulating piping 55 is prevented from excessively rising. The pressure accumulating piping 55 is provided with a fuel pressure sensor 61. The fuel pressure in the pressure accumulating piping 55 is detected by the fuel pressure sensor 61, and is monitored by the ECU 60. The ECU 60 includes a microcomputer (not shown) having a CPU, a RAM, I/O ports, and the like.

In the high-pressure fuel pump 11 in this embodiment, the cam 25 for reciprocating the plunger 21 is a cam whose cam profile is asymmetric for the suction stroke and the ejection stroke, as mentioned above. The cam profile of the cam 25 is shown in an enlarged view in FIG. 2.

In the foregoing embodiment, the moving speed of the plunger during the ejection stroke is reduced by setting a larger cam angle for the ejection stroke than for the suction stroke, the moving speed of the plunger during the ejection stroke may be reduced by other means. That is, according to the invention, as long as the high-pressure fuel pump is provided with suitable speed variation means for achieving a smaller changing rate of the capacity of the pressurizing chamber (a smaller plunger speed) during the ejection stroke than during the suction stroke, the speed variation means is not limited to means related to the cam configuration, but may be any other means.

While the invention has been described with reference to preferred embodiments thereof, it is to be understood that the invention is not limited to the disclosed embodiments or constructions. On the contrary, the invention is intended to cover various modifications and equivalent arrangements. In addition, while the various elements of the disclosed invention are shown in various combinations and configurations, which are exemplary, other combinations and configurations, including more, less or only a single embodiment, are also within the spirit and scope of the invention.

What is claimed is:

1. A high pressure fuel injection apparatus for an internal combustion engine having engine cylinders and comprising an injector for each engine cylinder, a pressure accumulator connected to each injector to distribute fuel to the injectors and consisting of a single high-pressure fuel pump connected to the pressure accumulator for pumping high pressure fuel from a fuel tank to the pressure accumulator, the fuel pump comprising:

a plunger disposed in a cylinder, the cylinder defining a pressurizing chamber having a capacity that increases during a suction stroke of the plunger and decreases during an ejection stroke of the plunger;

a spill valve that spills fuel from the pressurizing chamber by being opened during the ejection stroke, ejects fuel from the pressurizing chamber by being closed during the ejection stroke, and regulates an amount of fuel ejected from the pressurizing chamber by electronically controlling a closing time of the spill valve; and a plunger driver that drives the plunger through the suction and ejection strokes at an acceleration that is less for the ejection stroke than for the suction stroke, wherein the plunger driver drives the single plunger.

2. A high pressure fuel injection apparatus according to claim 1, wherein the plunger driver is a cam having an asymmetric cam profile for the ejection stroke and the suction stroke, a cam angle for the rejection stroke is greater than a cam angle for the suction stroke.

3. A high pressure fuel injection apparatus according to claim 2, wherein the cam profile for the ejection stroke causes the acceleration of the plunger to be constant for a portion of the ejection stroke.

4. A high-pressure fuel injection apparatus according to claim 2, wherein the cam profile of the cam is set so that the changing speed of the capacity of the pressurizing chamber during the ejection stroke is made less than the changing speed of the capacity of the pressurizing chamber during the suction stroke.

5. A high-pressure fuel injection apparatus according to claim 4, wherein the cam profile is set so that the changing speed of the capacity of the pressurizing chamber with respect to the cam angle becomes substantially constant during at least a part of the ejection stroke.

6. A high pressure fuel injection apparatus for an internal combustion engine having engine cylinders and comprising an injector for each engine cylinder, a pressure accumulator connected to each injector to distribute fuel to the injectors and consisting of a single high-pressure fuel pump connected to the pressure accumulator for pumping high pressure fuel from a fuel tank to the pressure accumulator, a cam for driving the single high pressure fuel pump that pumps fuel from a fuel tank to an internal combustion engine, the fuel pump spilling fuel by opening a spill valve during an ejection stroke of a plunger within a pressurizing chamber defined by the plunger and a cylinder in which the plunger is disposed, the fuel pump ejecting fuel by closing the spill valve during the ejection stroke, an amount of fuel supplied to the internal combustion engine being regulated by electronically controlling a closing time of the spill valve, the cam comprising:

a cam profile that is asymmetric for the ejection stroke and a suction stroke; and a cam angle for the ejection stroke being greater than a cam angle for the suction stroke, wherein the cam drives the single plunger.

7. A high pressure fuel injection apparatus according to claim 6, wherein the cam profile for the ejection stroke causes the acceleration of the plunger to be constant for a portion of the ejection stroke.

8. A high pressure fuel injection apparatus according to claim 6, wherein the cam profile is set so that the changing speed of the capacity of the pressurizing chamber with respect to the cam angle becomes substantially constant during at least a part of the ejection stroke.

9. A high pressure fuel injection apparatus according to claim 6, wherein the cam is a plunger-driving cam for driving the plunger through the suction and ejection strokes.

10. A method of operating a high pressure fuel injection apparatus for an internal combustion engine having engine cylinders and comprising an injector for each engine cylinder, a pressure accumulator connected to each injector to distribute fuel to the injectors and consisting of a single high-pressure fuel pump connected to the pressure accumulator for pumping high pressure fuel from a fuel tank to the pressure accumulator, the fuel pump having a pressurizing chamber defined by a cylinder and a plunger that reciprocates within the cylinder, the pressurizing chamber having a capacity that increases during a suction stroke of the plunger and decreases during an ejection stroke of the plunger, the fuel pump also including a spill valve that spills fuel from the pressurizing chamber by being opened during the ejection stroke, ejects fuel from the pressurizing chamber by being closed during the ejection stroke, and regulates an amount of fuel ejected from the pressurizing chamber by electronically controlling a closing time of the spill valve, the method comprising:

driving the plunger through the suction and ejection strokes at an acceleration that is less for the ejection stroke than for the suction stroke.

* * * * *